US006227268B1

(12) United States Patent
Lefever et al.

(10) Patent No.: US 6,227,268 B1
(45) **Date of Patent: *May 8, 2001**

(54) FORM FOR STEPPED-BOTTOM BASKET

(75) Inventors: Leane M. Lefever, Frazeysburg; Christine A. Hudson Corp, Coshocton; Tim Teal, Mount Vernon; Kenneth J. Cramer, Coshocton; Hoy M. Cox, Millersburg; Mandy Wagner, Dresden, all of OH (US)

(73) Assignee: The Longaberger Company, Newark, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/966,309

(22) Filed: Nov. 7, 1997

Related U.S. Application Data

(62) Division of application No. 08/583,247, filed on Jan. 5, 1996, now Pat. No. 5,938,057.

(51) Int. Cl.[7] ..... B27J 1/00
(52) U.S. Cl. ..... 147/48
(58) Field of Search ..... 147/48; 217/122, 217/123; 29/463

(56) References Cited

U.S. PATENT DOCUMENTS

| | | | | |
|---|---|---|---|---|
| 3,056 | * | 4/1843 | Downs | 147/48 |
| 450,111 | * | 4/1891 | Snow | 147/48 |
| 450,114 | * | 4/1891 | Snow | 147/48 |
| 662,091 | | 11/1900 | Ricke . | |
| 856,901 | * | 6/1907 | Noe | 147/48 |
| 901,676 | * | 10/1908 | Bowman | 147/48 |
| 1,116,820 | | 11/1914 | Huke . | |
| 1,491,933 | * | 4/1924 | Sullivan | 147/48 |
| 1,595,349 | | 8/1926 | McKane . | |
| 1,636,252 | * | 7/1927 | Siebert | 296/191 X |
| 1,724,293 | | 8/1929 | Lawrence . | |
| 5,868,958 | * | 2/1999 | Comisford, Jr. | 249/117 |
| 5,938,057 | * | 8/1999 | Cramer et al. | 217/123 |

* cited by examiner

*Primary Examiner*—John M. Husar
(74) *Attorney, Agent, or Firm*—Porter, Wright, Morris & Arthur LLP

(57) ABSTRACT

A form for making a stepped-bottom basket including a three-dimensional L-shaped frame vertically partitioned into two segments that are releasably fastenable to one another. The first segment includes top, front, rear and side walls that define the shape of the interior of the deep portion of the stepped bottom basket and the second segment includes top, front, rear and side walls that define the shape of the interior of the shallow portion of the stepped bottom basket. The second segment may include an integral splint guide capable of receiving inner reinforcement splints for the bottom of the shallow upper basket portion. Adjacent walls of the segments may be adapted for securely fitting and fastening the segments together.

19 Claims, 22 Drawing Sheets

FORM FOR STEPPED-BOTTOM BASKET

This is a division of application Ser. No. 08/583,247, filed Jan. 5, 1996, and issued as U.S. Pat. No. 5,938,057 on Aug. 17, 1999 the text of which is incorporated by reference as if rewritten herein.

BACKGROUND OF THE INVENTION

This invention relates generally to forms used in making woven baskets having bottom portions at each of at least two different levels, such that their outer bottom portions may rest upon surfaces at different heights. These baskets will be referred to as "stepped-bottom" baskets.

Stepped-bottom baskets provide conveniently accessible storage for differently sized items. Two-level baskets shaped like an inverted "L" are common. The deeper portion of these baskets may be used to hold larger items, such as reading materials and craft supplies, while the shallower portion may be used to hold smaller items, such as eyeglasses, pens, and scissors. A user seated in a chair easily may reach into a stepped-bottom basket placed alongside the chair to retrieve both the large and small items stored in the basket. Besides being used on flat surfaces for storing differently sized items, these baskets also may be placed on stairs, with the bottom of the deeper portion resting upon one stair tread and the bottom of the shallower portion resting upon the next higher stair tread, and used to assemble items to be taken up or down the stairs.

Woven wooden baskets generally are made by shaping the basket over a basket mold, or form. Weaving splints are conformed to the form either prior to or during basket construction and are intertwined to form various basket panels.

Basket forms typically have a shape that defines the shape of the interior of the basket. Although it might be possible to weave a stepped-bottom basket using a unitary form that conforms to the shape of the basket interior, it would be difficult to produce a high-quality basket using such an unwieldy form.

SUMMARY OF THE INVENTION

It is an object of the present invention to provide a form suitable for use in weaving a stepped-bottom basket, in which the form is partitioned to ease the weaving process and to allow consistent production of high-quality baskets. This objective is achieved in a form that comprises a three-dimensional L-shaped frame that is vertically partitioned into two segments that are releasably fastenable to one another. The first segment includes top, front, rear and side walls that define the shape of the interior of the deep portion of the stepped bottom basket and the second segment includes top, front, rear and side walls that define the shape of the interior of the shallow portion of the stepped bottom basket. The second segment may include an integral splint guide capable of receiving inner reinforcement splints for the bottom of the shallow upper basket portion. Adjacent walls of the segments may be adapted for fitting and fastening the segments together.

These and further objects of the invention will become apparent from the following detailed description.

DETAILED DESCRIPTION OF PREFERRED EMBODIMENT(S)

The invention comprises a form for making a stepped-bottom basket. The invention is shown and described with reference to a two-level embodiment of a stepped-bottom basket, but it also is applicable to forms for other stepped-bottom baskets, such as three-level baskets having either successively shallower bottom portions, or having a deep center section with shallower sections on either side.

Figure 1:
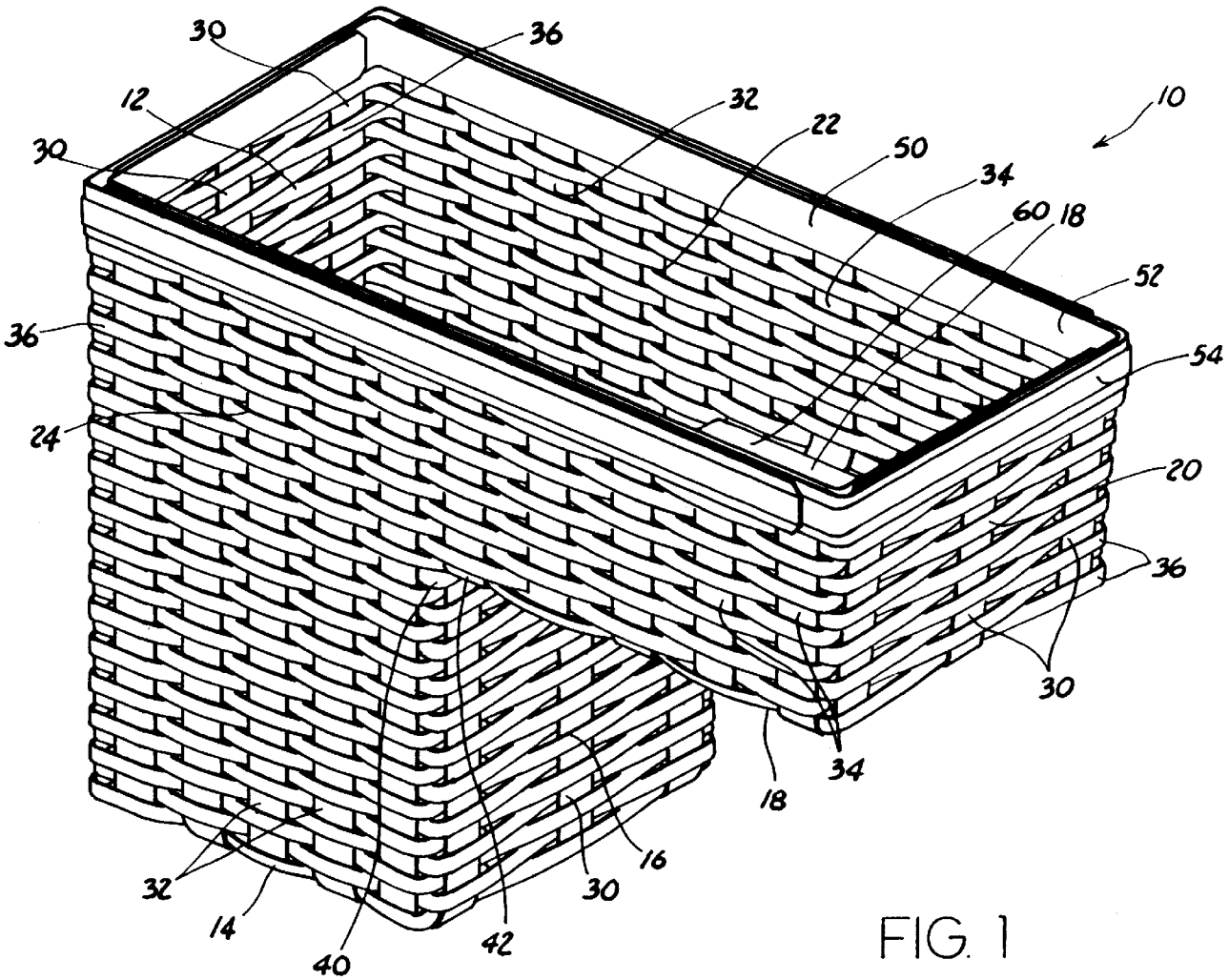
FIG. 1 is a right rear perspective view of an embodiment of the stepped-bottom basket of the present invention.

FIG. 1 shows a unitary basket 10 having a stepped bottom, that is, a basket having at least two bottom portions at different levels with an intermediate wall separating the upper and lower bottom portions. These bottom portions define basket sections of different depths. The combined basket form of the present invention is shaped to conform substantially to the interior of the above-described basket.

Figure 18:
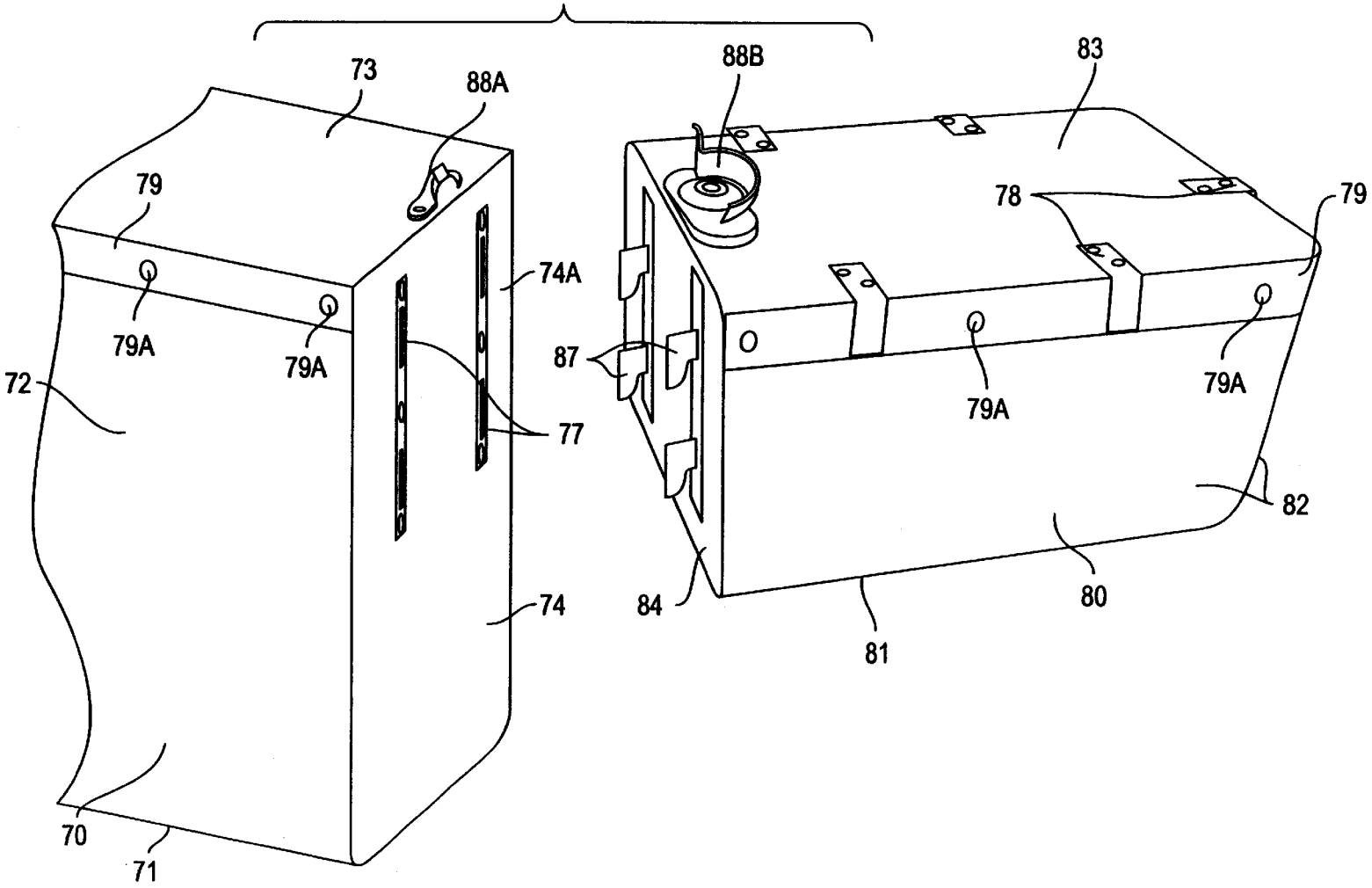
FIG. 18 is a side view of the first and second segments, showing the connectors used to secure the segments together to form the combined form.
Figure 21B:
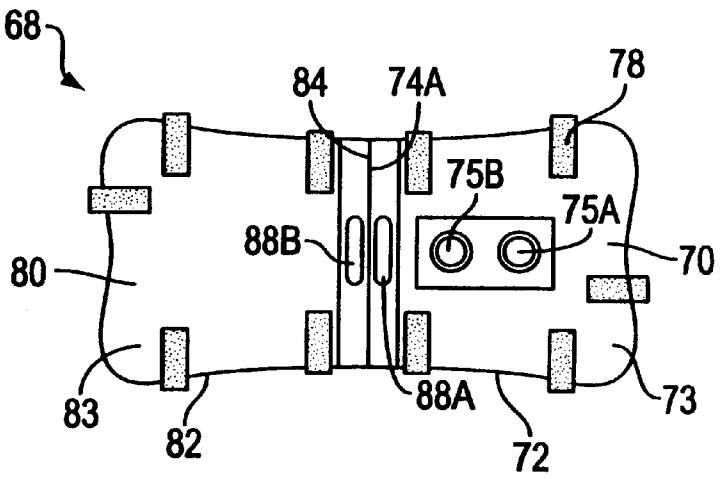
FIG. 21B is a bottom view of the form of FIG. 21A.

FIGS. 18 and 21B show a vertically partitioned form 68 for a stepped-bottom basket, according to the present invention. The combined form 68 defines a three-dimensional L-shaped frame, best shown in FIGS. 16 and 21A. The first segment 70, shown in FIGS. 19A through 19E, is similar to conventional forms used in making rectangular woven baskets. The first segment 70 includes top 71 and side 72 walls that define the shape of the interior of the deeper section of the basket, and a bottom 73.

Two recesses 75A, 75B (best shown in FIG. 19D) may be provided in the bottom 73 for use in supporting the form 70 on the weaving horse. The substantially centered recess 75A is used to support the first segment 70 on the weaving horse when the first segment 70 is used alone. The second recess 75B is offset toward the back 74 of the first segment 70. The first segment 70 may be shifted on the weaving horse from the centered recess 75A to the offset recess 75B after the second segment 80 is added, to adjust for the new center of gravity of the combined form 68.

The second segment 80, shown in FIGS. 20A through 20E, also includes top 81 and side 82 walls that define the shape of the interior of the shallow rear section, and a bottom 83.

Figure 15:
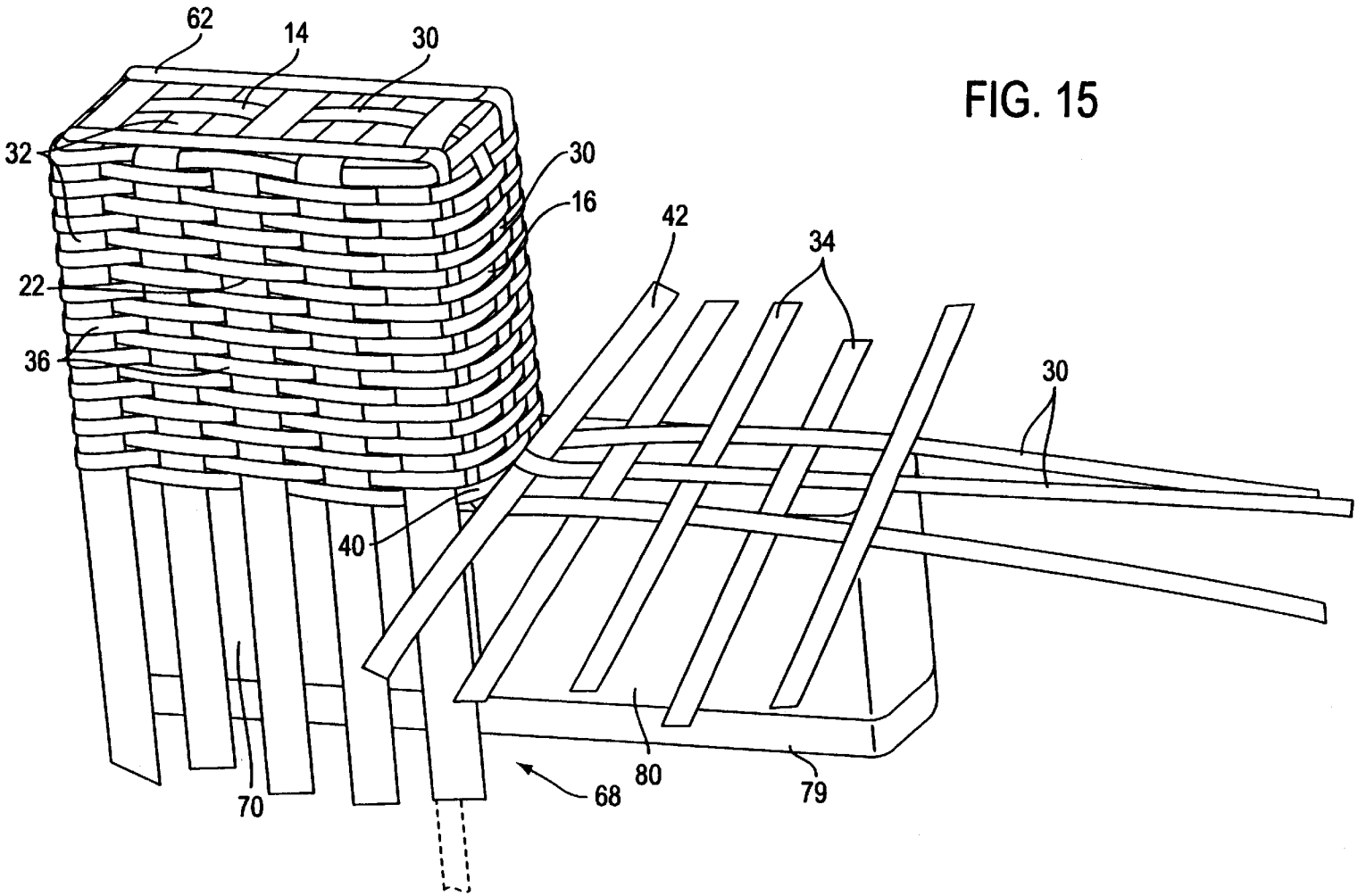
FIG. 15 is a view of the short splints woven through the upsplints resting upon the second segment to form the upper bottom basket panel.

The top 81 of the second segment 80 (shown in FIG. 20E) may include an integral guide for forming the upper bottom panel 18. The guide defines recessed slots 86 for holding the inner reinforcements 60 in place. FIG. 15. shows an inner reinforcement 60 (partially hidden by the upsplint 30) inserted into a slot 86 on the second segment 80.

Figure 19C:
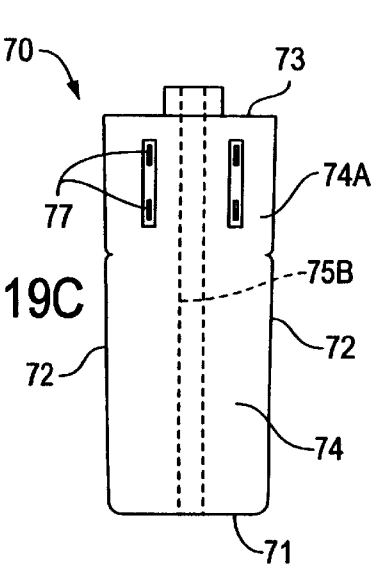
FIG. 19C is a rear view of the first segment.
Figure 19B:
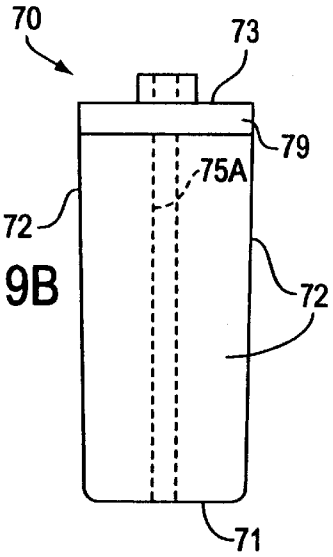
FIG. 19B is a front view of the first segment.
Figure 19A:
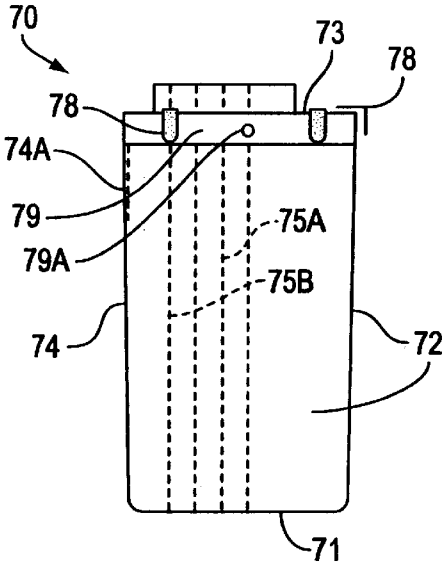
FIG. 19A is a side view of the first segment.
Figure 19F:
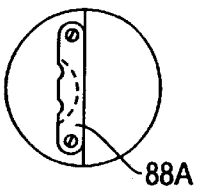
FIG. 19F is a detail view of a bottom latch of the first segment.
Figure 19E:
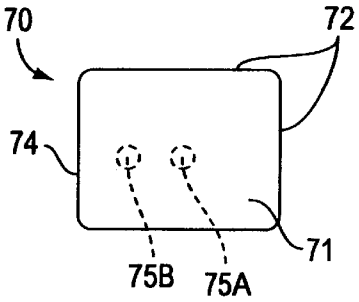
FIG. 19E is a top view of the first segment.
Figure 19D:
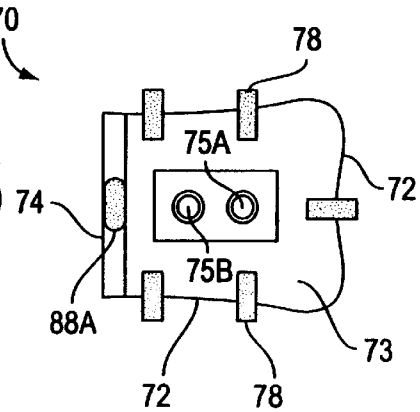
FIG. 19D is a bottom view of the first segment.
Figure 20A:
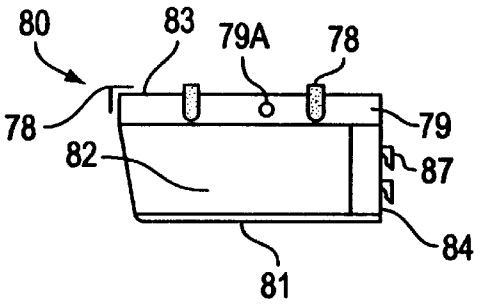
FIG. 20A is a side view of the second segment.
Figure 20B:
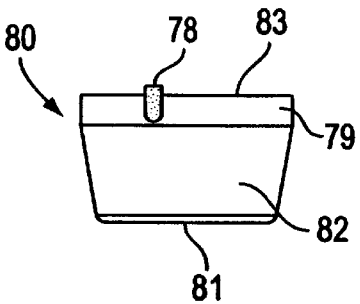
FIG. 20B is a rear view of the second segment.
Figure 20C:
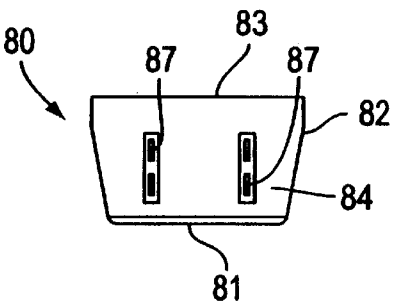
FIG. 20C is a front view of the second segment.
Figure 20D:
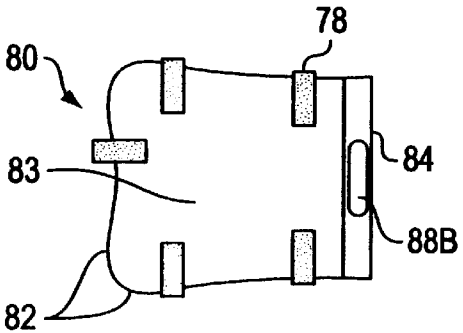
FIG. 20D is a bottom view of the second segment.
Figure 20E:
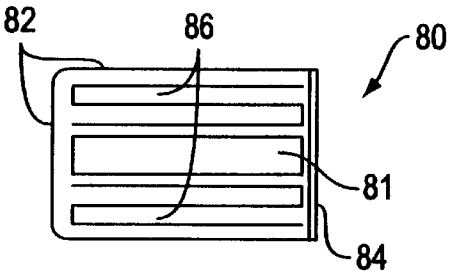
FIG. 20E is a top view of the second segment.
Figure 20F:
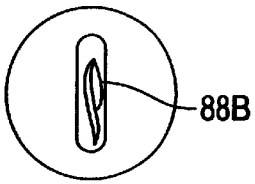
FIG. 20F is a detail view of the second segment.
Figure 21A:
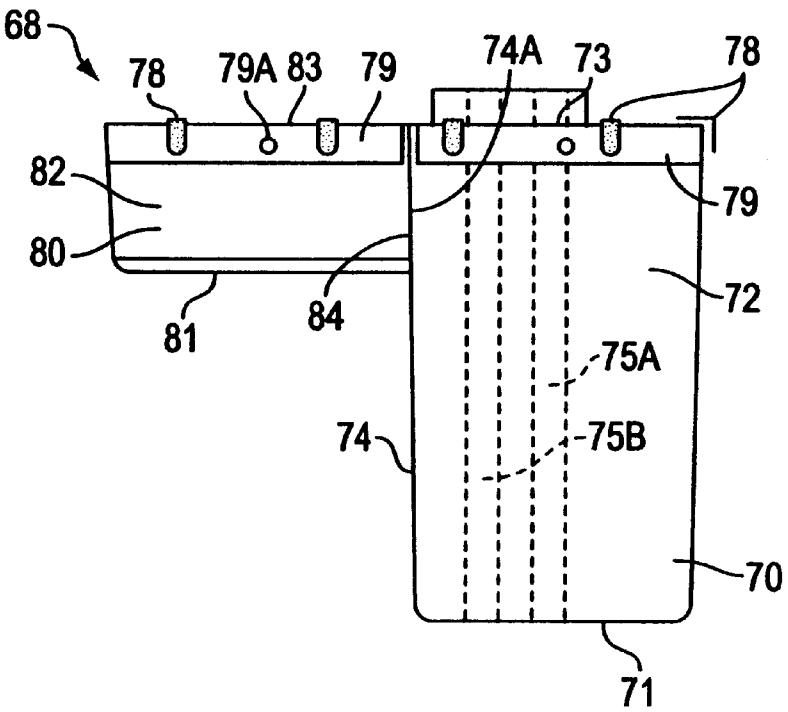
FIG. 21A is a side view of the combined form resulting from the connection of the first and second segments.

As shown in FIGS. 18 and 21A, the front wall 84 of the second segment 80 may be connected to the back wall 74 of the first segment 70, with the bottoms 73, 83 of the segments aligned with one another. The upper back wall 74A of the first segment 70 is shaped for mating with the front wall 84 of the second segment 80. The front wall 84 may include a projecting notch or bracket 87 (shown in FIG. 20A) that engages a corresponding recess 77 (shown in FIG. 19C) in the upper back wall 74A of the first segment 70 to secure the form segments together. Other methods for connecting the two segments 70, 80, such as a dovetail joint, also may be suitable if they do not alter the outer contour of the form 68. Fasteners, such as a latch 88A, 88B, may be provided on the form bottoms 73, 83 to hold the segments 70, 80 securely together as shown in FIGS. 19D, 20D, and 21B. FIGS. 21F and 22F show details of a suitable sash-type latch.

A protective band 79 may be provided along the three outer sides of each segment 70, 80. The band 79 covers the bottom of the exposed sides of the combined form 68 and protects the form 68 from damage when the splint ends are tacked to the top bands 50. The band 79 also may be provided with guides or clips 78 that hold an inner top band against the form 68 during weaving. Bores 79A may be formed in the band 79 to guide the placement of holes to be drilled through the bands 50 and upper splint ends. These holes may be used for fastening handles, lids or other features or accessories to the basket 10.

The basket constructed using the form of the present invention will be described in detail to aid in understanding how the form is used. Although the basket may be used with only its lower bottom panel resting on a supporting surface, it also may be use with the lower and upper bottom panels each resting upon surfaces at different levels, such as successive stair treads or a floor and an adjacent raised ledge. In the description below, the term "front" will be used to refer to the part of the basket that would be furthest from the stair risers if the basket was placed on stairs and the terms "upper rear" and "lower rear" will be used to refer to the parts of the basket that would be closest to higher and lower stair risers, respectively.

Figure 2:
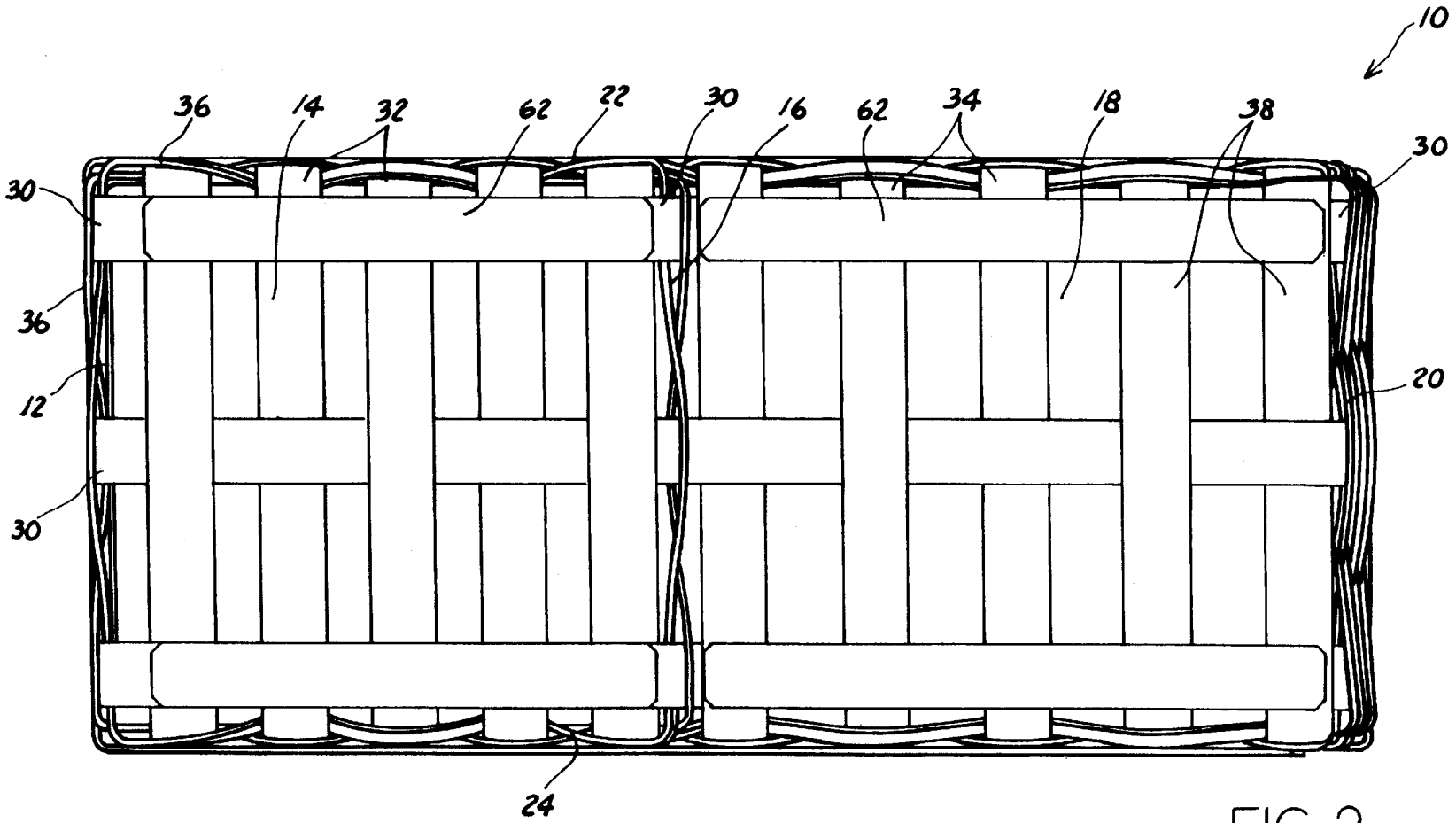
FIG. 2 is a bottom view of the basket of FIG. 1.
Figure 7:
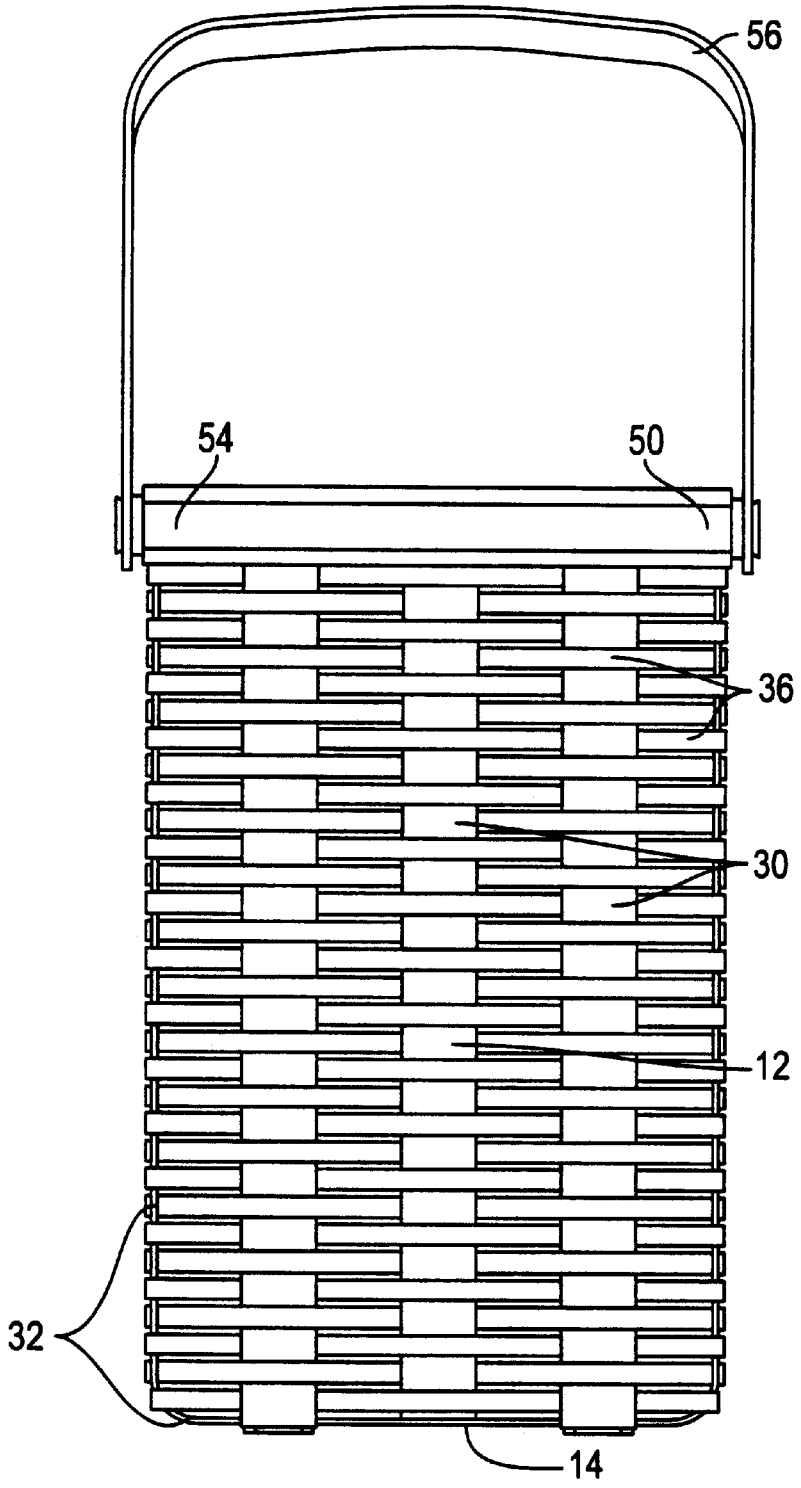
FIG. 7 is a front view of the basket of FIG. 5.
Figure 9:
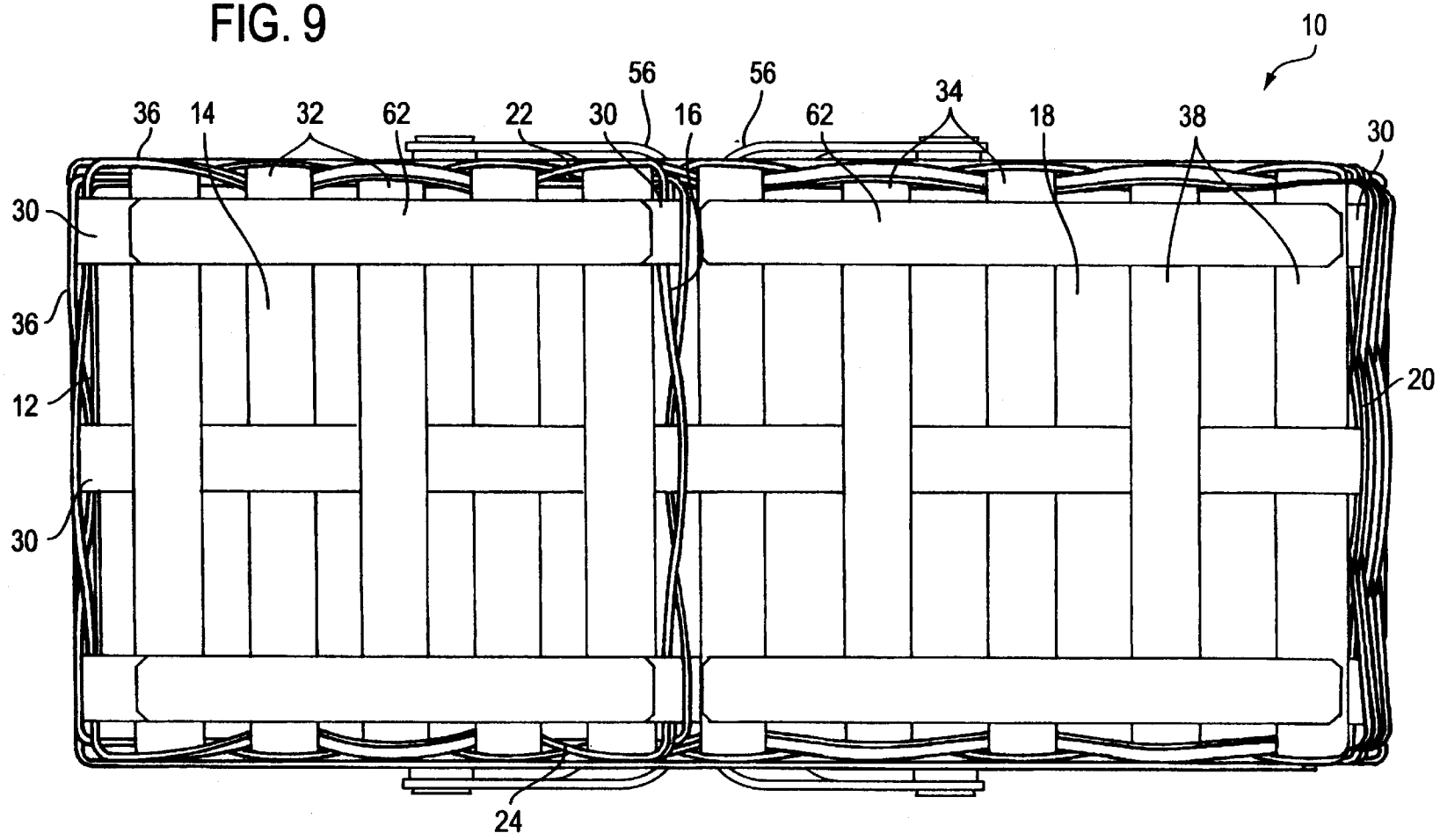
FIG. 9 is a bottom view of the basket of FIG. 5.

The basket 10 includes a substantially vertical front panel 12, best shown in FIG. 7. A lower bottom panel 14 (shown in FIGS. 2 and 9) extends transversely from the bottom of the front panel 12. The bottom panel 14 extends to the bottom of an intermediate or lower rear panel 16 which is located between the front panel 12 and an upper rear panel 20. The top of the lower rear panel 16 ends at a distance below the top of the front panel 12.

Figure 4:
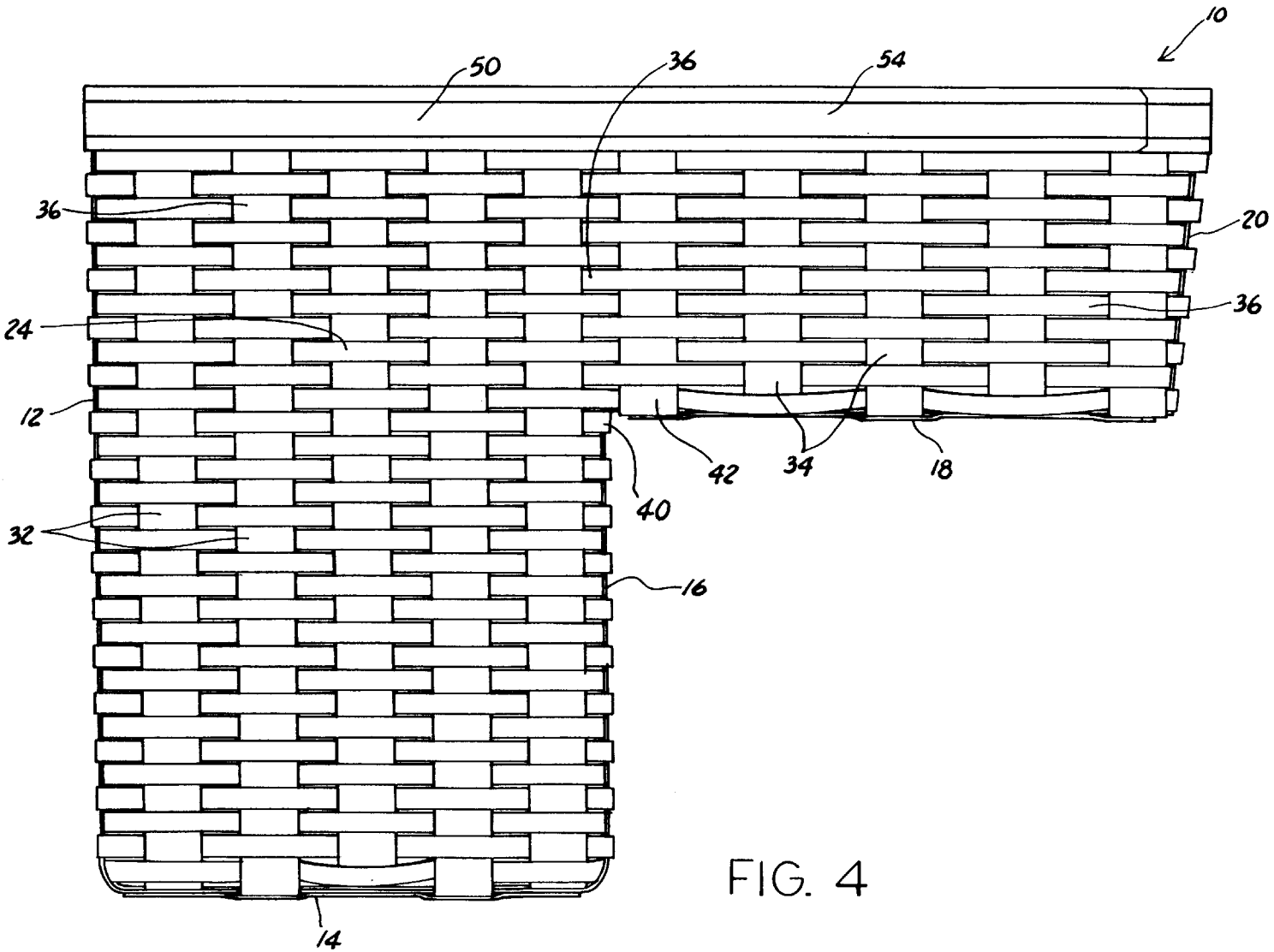
FIG. 4 is a right side view of the basket of FIG. 1, the left side being a mirror image thereof.
Figure 8:
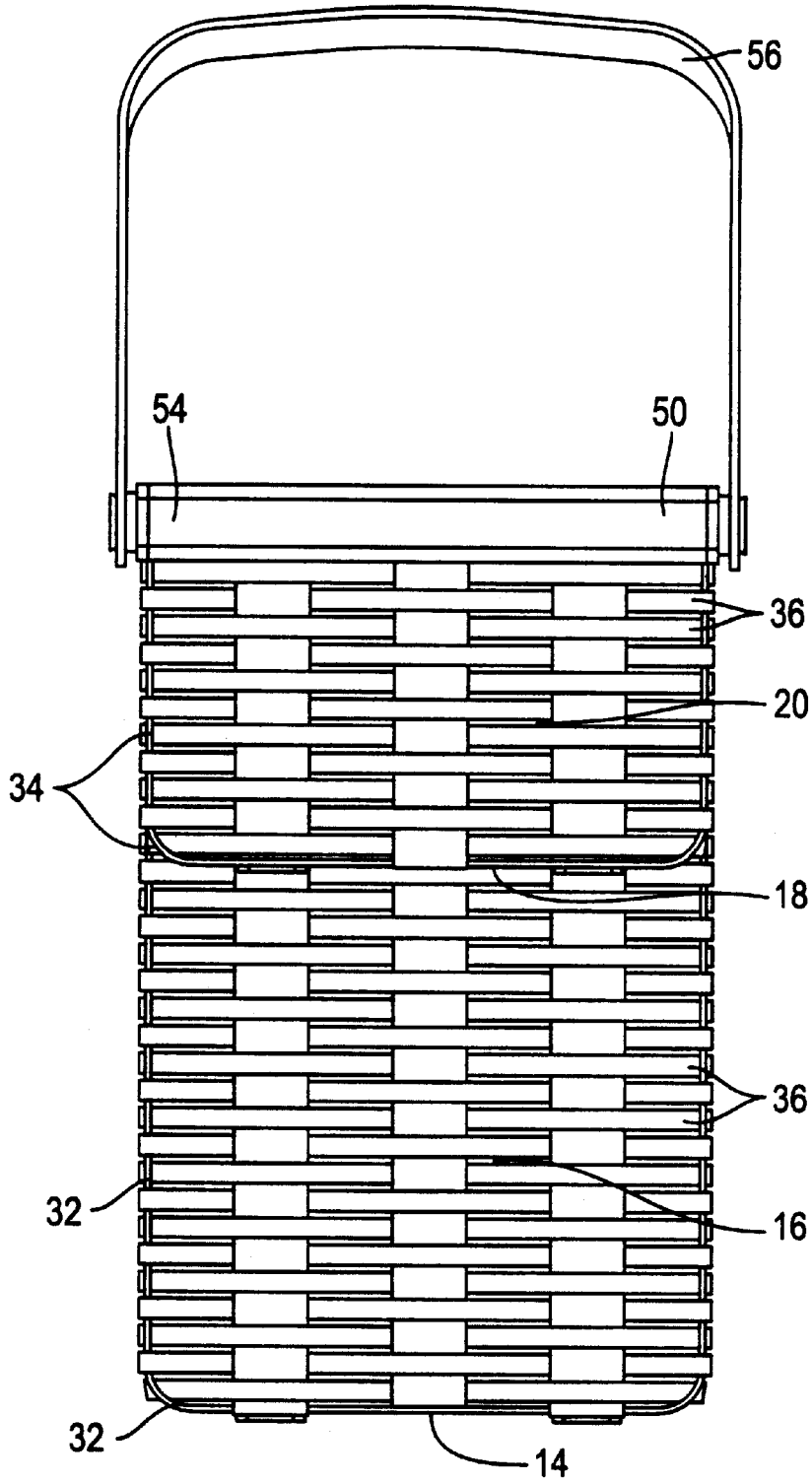
FIG. 8 is a rear view of the basket of FIG. 5.

An upper bottom panel 18 extends transversely from the top of the lower rear panel 16. The upper rear panel 20 (best shown in FIGS. 1 and 8) extends transversely from the opposite end of the upper bottom panel 18. The upper rear panel 20 is substantially parallel to the lower rear 16 and front 12 panels. Left 22 and right 24 side panels, best shown in FIGS. 4 and 6, each defines an inverted L-shape. The side panels 22, 24 extend laterally from the front panel 12 to the upper rear panel 20, in communication with the lower bottom panel 14, lower rear panel 16 and upper bottom panel 18.

The front panel 12, lower rear panel 16, and front portions of side panels 22, 24 define a deep front storage area while the upper rear panel and rear portions of side panels 22, 24 define a shallow rear storage area. The upper region of the front storage area is open to and integral with the rear storage area.

The panels are formed from thin flexible strips, such as wood splints. Upsplints 30 extend continuously from the top of the front panel 12, along the length of the lower bottom panel 14, up the lower rear panel 16, along the length of the upper bottom panel 18, to the top of the upper rear panel 20. The cross splints 32 extend from the top of the left side panel 22, along the width of the lower bottom panel 14 and to the top of the right side panel 24. Short splints 34 extend from the top of the left side panel 22, along the width of the upper bottom panel 18, to the top of the right side panel 24. Horizontal splints 36, referred to as weave strips, extend around the front, left, right and a rear panel of the basket 10 at predetermined distances from each other. The weave strips 36 generally are woven through the upsplints 30, cross splints 32, and short splints 34 in a conventional alternating over-and-under weave pattern.

The upsplints 30 in the lower rear panel 16 are bent transversely to the lower rear panel 16 just above the top of the uppermost weave strip 40 in the lower rear panel. These upsplints 30 are woven with short splints 34 to form the upper bottom panel 18.

The stepped-bottom basket 10 may be constructed using the following steps:

(1) Forming the lower bottom panel 14;

(2) Placing the lower bottom panel over the first form segment;

(3) Constructing the lower rear panel 16 and the portions of the front 12, left 22 and right 24 panels that extend from the lower bottom panel 14 to the upper bottom panel 18 over the first segment;

(4) Attaching the second form segment to the first segment;

(5) Forming the upper bottom panel 18 from the upsplints 30 in the lower rear panel 16 over the second form segment; and (6) Constructing the upper rear panel 20 and the remainder of the front 12, left 22 and right 24 panels from the upper bottom panel 18 to the basket rim 50 over the combined form.

Figure 12:
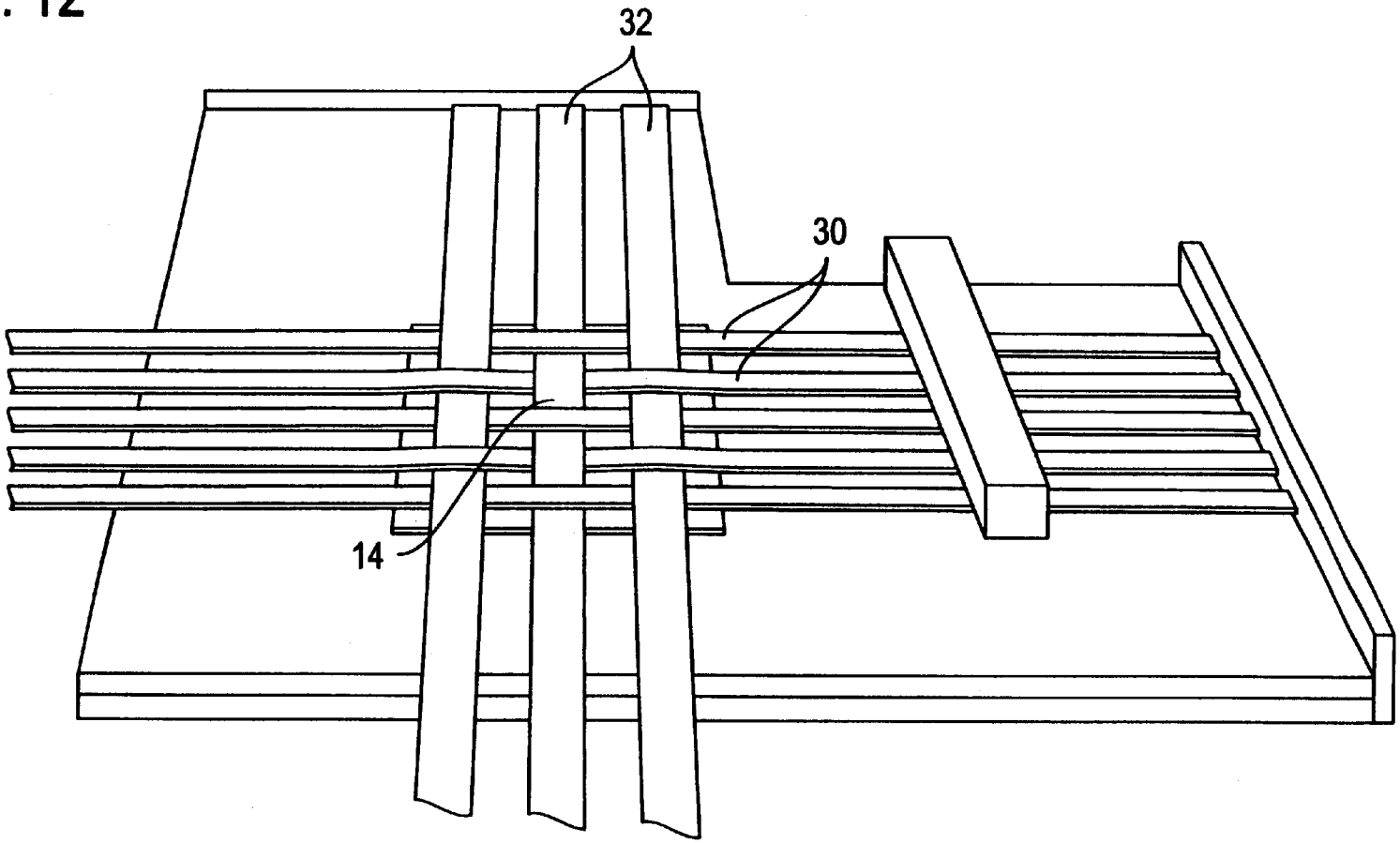
FIG. 12 is a view of a lower bottom panel being constructed before the bottom panel is applied to the first segment of the present invention.

More specifically, the basket 10 may be constructed by first forming the lower bottom panel 14 as shown in FIG. 12. Construction of this panel 14 is similar to construction of the bottom panel of a conventional rectangular splint basket, with the bottom panel 14 being formed by weaving cross splints 32 through an array of upsplints 30 to define a central woven section with the splints ends extending outwardly therefrom.

The cross splints 32 that extend outwardly from the woven section will form the vertical framework of the side panels 22, 24 of the deep front portion of the basket 10, so they must be at least as long as the desired basket height (from the lower bottom panel 14 to the top rim 50) plus the width of the lower bottom panel 14. The upsplints 30 that extend outwardly from the woven section will form the vertical framework of the front 12 and upper 20 and lower 16 rear panels of the basket, and the base of the upper bottom panel 18. The upsplints 30 therefore must be at least as long as the sum of twice the desired basket height and the combined lengths of the upper 18 and lower 14 bottom panels.

Figure 3:
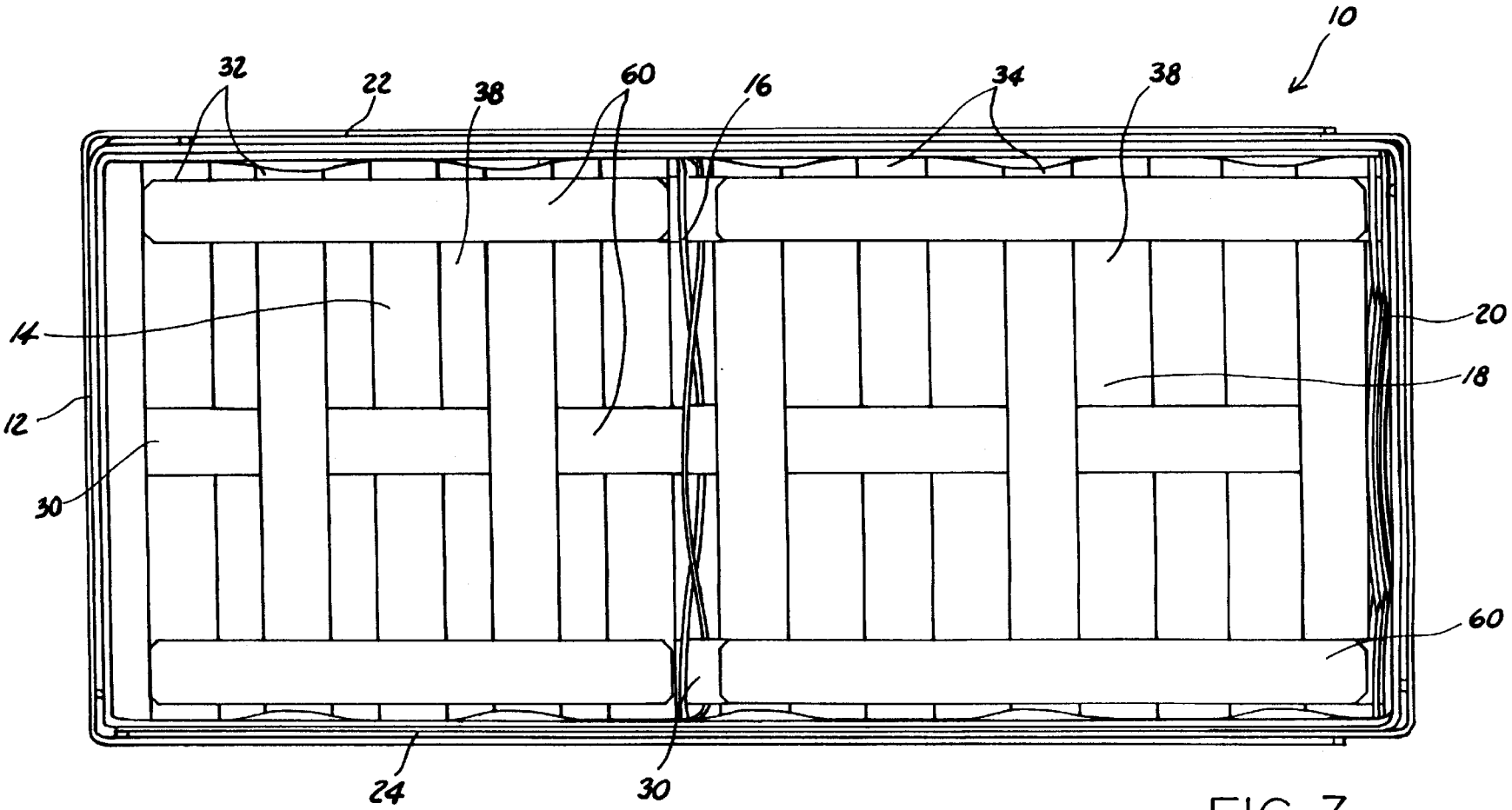
FIG. 3 is a top view of the basket of FIG. 1.
Figure 10:
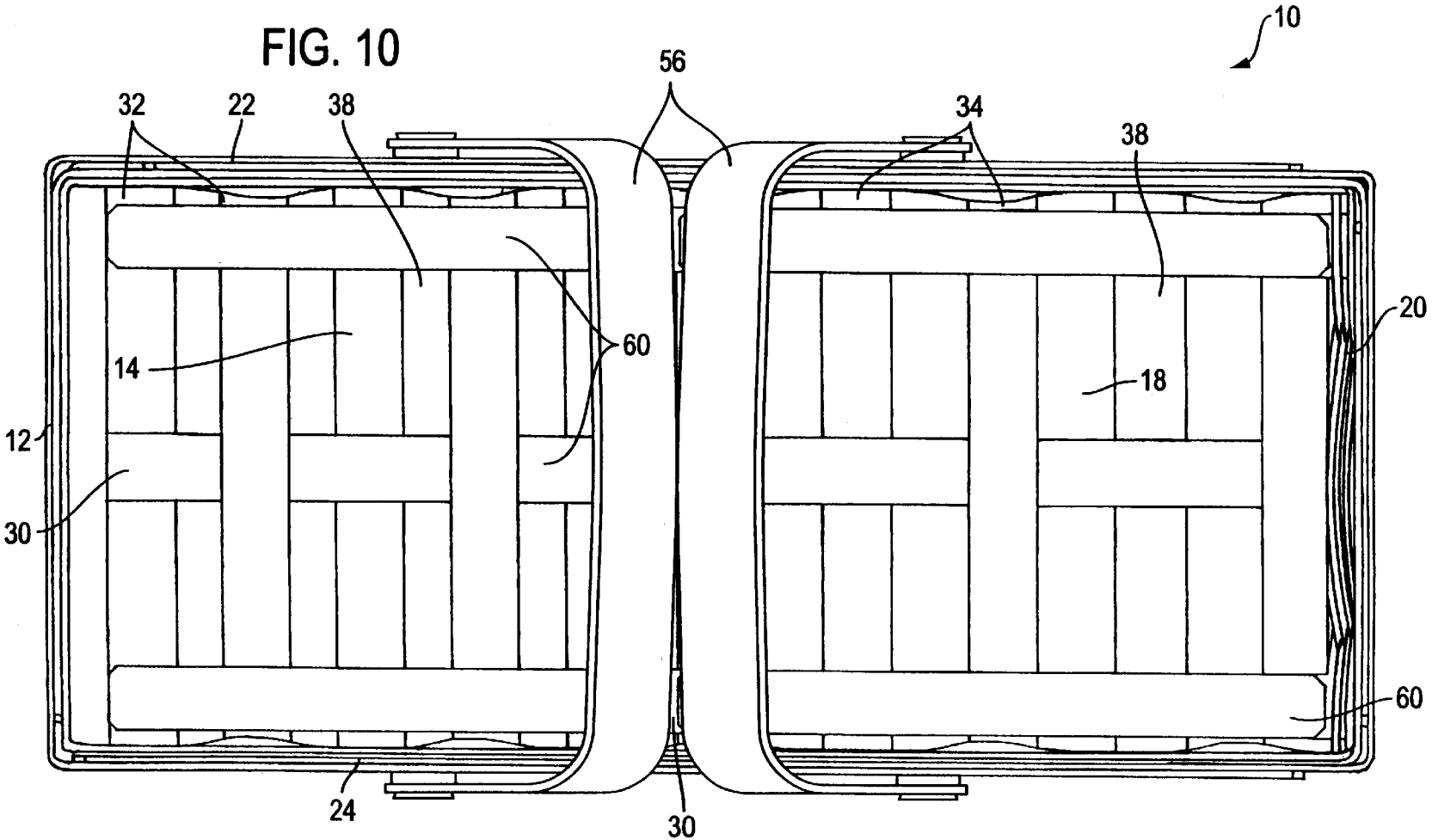
FIG. 10 is a top view of the basket of FIG. 5.
Figure 11:
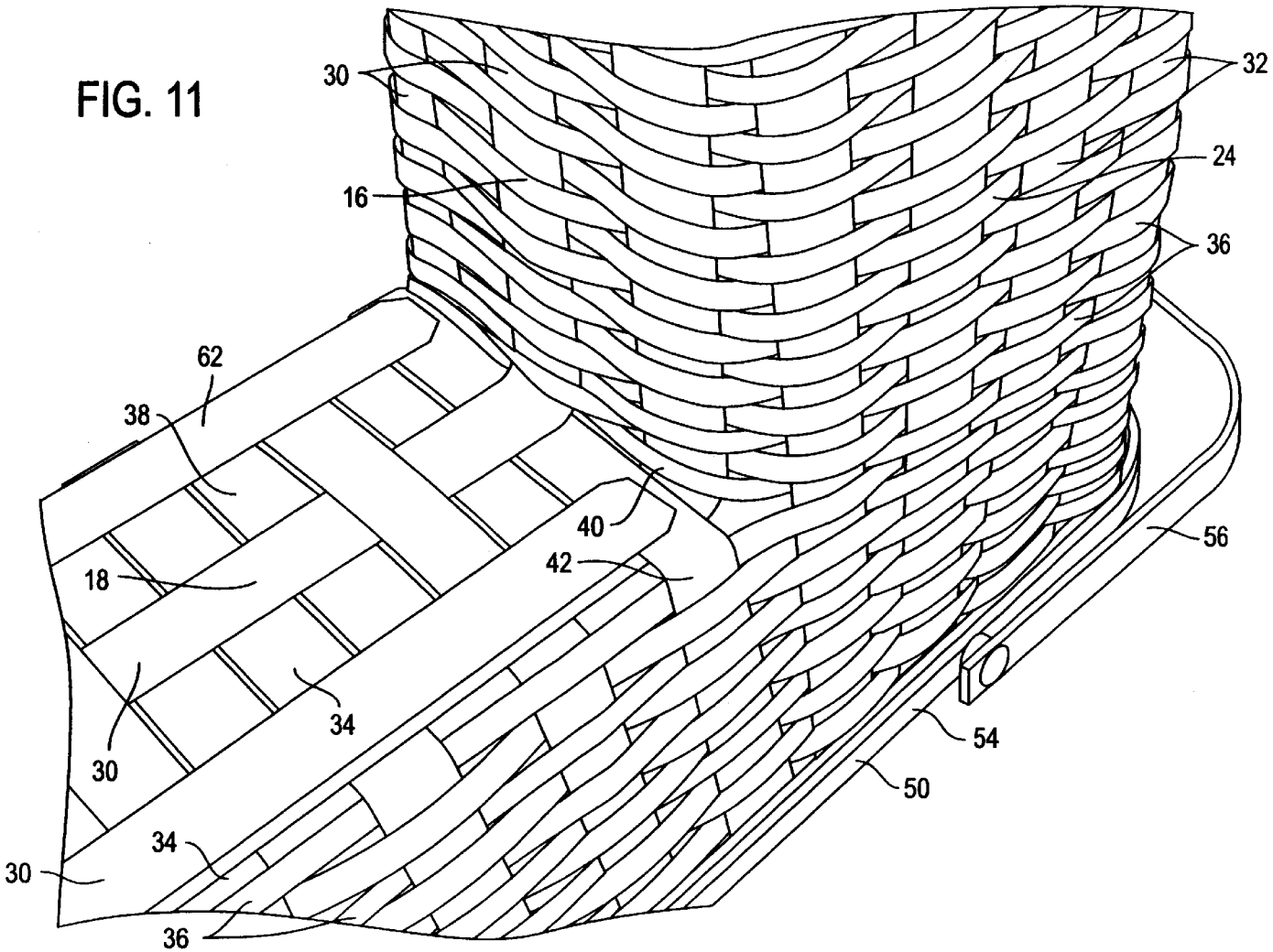
FIG. 11 is a partial detail view of the basket of FIG. 5, particularly illustrating the transition area between the lower rear panel wall and the upper bottom pane that is formed over the area where the first form segment intersects the second segment.

As explained further below, the bottom panel 14 may include inner 60 or outer 62 reinforcements, or both, if desired. These reinforcements provide a finished appearance and increase the strength of the bottom panel 14. Inner reinforcements 60, shown in FIGS. 3 and 10, are positioned on the work surface before forming of the bottom panel 14 begins. Recessed slots may be provided in the work surface to prevent the inner reinforcements 60 from sliding out of place. Upsplints 30 are arranged on the work surface over the inner reinforcements 60, in spaced parallel relationship to one another. Fill splints 38, which do not extend beyond the edges of bottom panel, may be arranged between the upsplints 30 to reduce the openness of the bottom panel 14.

Cross splints 32 are woven through the parallel upsplints 30 and fill splints 38 in a desired pattern, with an alternating, over-and-under pattern being preferred. A double thickness of cross splints 32 and upsplints 30 may be used to increase the strength and rigidity of the finished basket 10 without sacrificing flexibility during weaving. The first cross splint 32 generally is spaced at a distance from the front panel 12 end of the upsplints 30 that is about equal to the desired basket height. This will cause the woven panel 14 to be located asymmetrically with respect to the upsplints 30, with the upsplints 30 extending beyond the opposite side of the finished panel 14 being about as long as the desired height of the basket plus the combined lengths of the upper 18 and lower 14 bottom panels. Additional cross splints 32 are woven though the upsplints 30 until the desired number of cross splints 32 in the lower bottom panel 14 is reached.

Outer reinforcements 62 (shown in FIGS. 2 and 9) may be positioned on the exterior of the woven bottom panel 14, usually overlaying the upsplints 30 and any inner reinforcements 60. The outer reinforcements 62 are secured to the splints in the bottom panel 14 and any underlying reinforcements 60, preferably by fasteners, such as tacks.

The remainder of the basket 10 is constructed using the basket form 68. As described above, the form 68 is vertically partitioned into detachably connected segments 70, 80, as shown in FIGS. 18 and 21A. The first segment 70 defines the shape of the interior of the deep, front section of the basket 10 and the second segment 80 defines the shape of the interior of the shallow rear section.

When the form 68 is partitioned vertically, the first segment 70 initially is used alone to form the lower rear panel 16 and the lower portions of the front 12, left 22 and right 24 panels, that is, the portions of the front 12, left 22 and right 24 panels that extend from the lower bottom panel 14 to the upper bottom panel 18. The second segment 80 is connected to the first segment 70 for use in forming the upper bottom panel 18, the upper rear panel 20 and the remainder of the front 12 and side 22, 24 panels. Although it also would be possible to partition the form 68 horizontally, i.e., with a first segment defining the interior of the lower bottom portion of the basket only and a second segment defining the interior of the entire upper portion, the vertically partitioned form 68 is preferred for ease of weaving.

Figure 13:
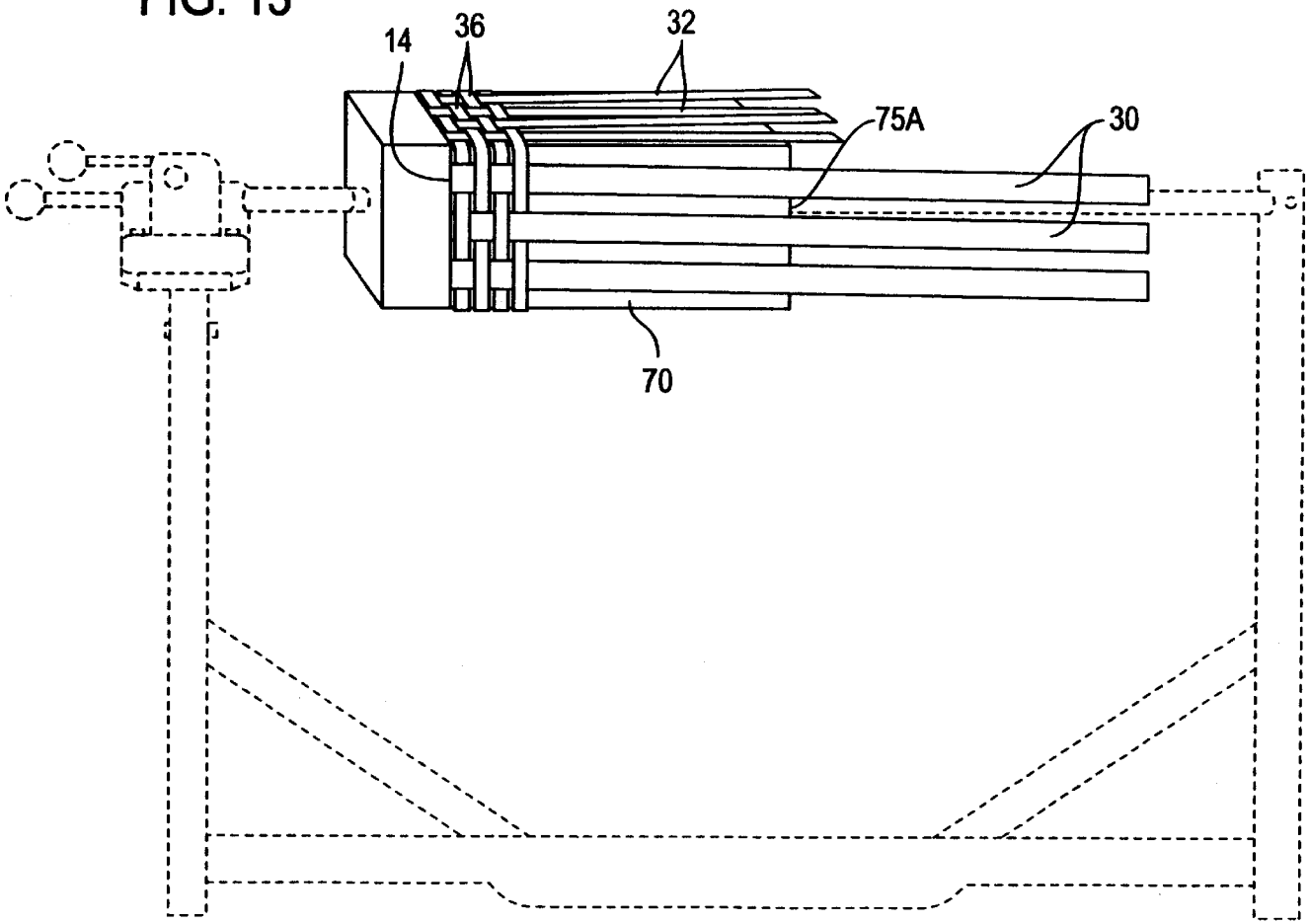
FIG. 13 is a view of the first segment supported on a weaving horse, with the lower bottom panel clamped to the form segment and the lower front and left side panels being constructed over the segment.

As shown in FIG. 13, the lower bottom panel 14 is overlaid on the top 71 of the first segment 70, which is shown supported on a weaving horse in FIG. 13. The formed panel 14 is secured to the segment 70 by a conventional "hold-down" or clamp. The upsplints 30 and cross splints 32 are bent to conform them to the sides 72 of the segment 70. The ends of the upsplints 30 corresponding to the upper bottom panel 18 and the upper rear panel 20 extend a distance beyond the bottom 73.

Weave strips 36 are woven through the splints 30, 32 in any desired pattern, with an alternating, over-and-under pattern being preferred. These weave strips 36 will form the cross-weaving, or horizontal structure, of the finished basket 10. As with the cross splints 32 and upsplints 30, a double thickness of weave strips 36 may be used. Successive rows of weave strips 36 are added until the basket panels reach a height slightly less than the desired height of the lower rear panel 16.

Figure 14:
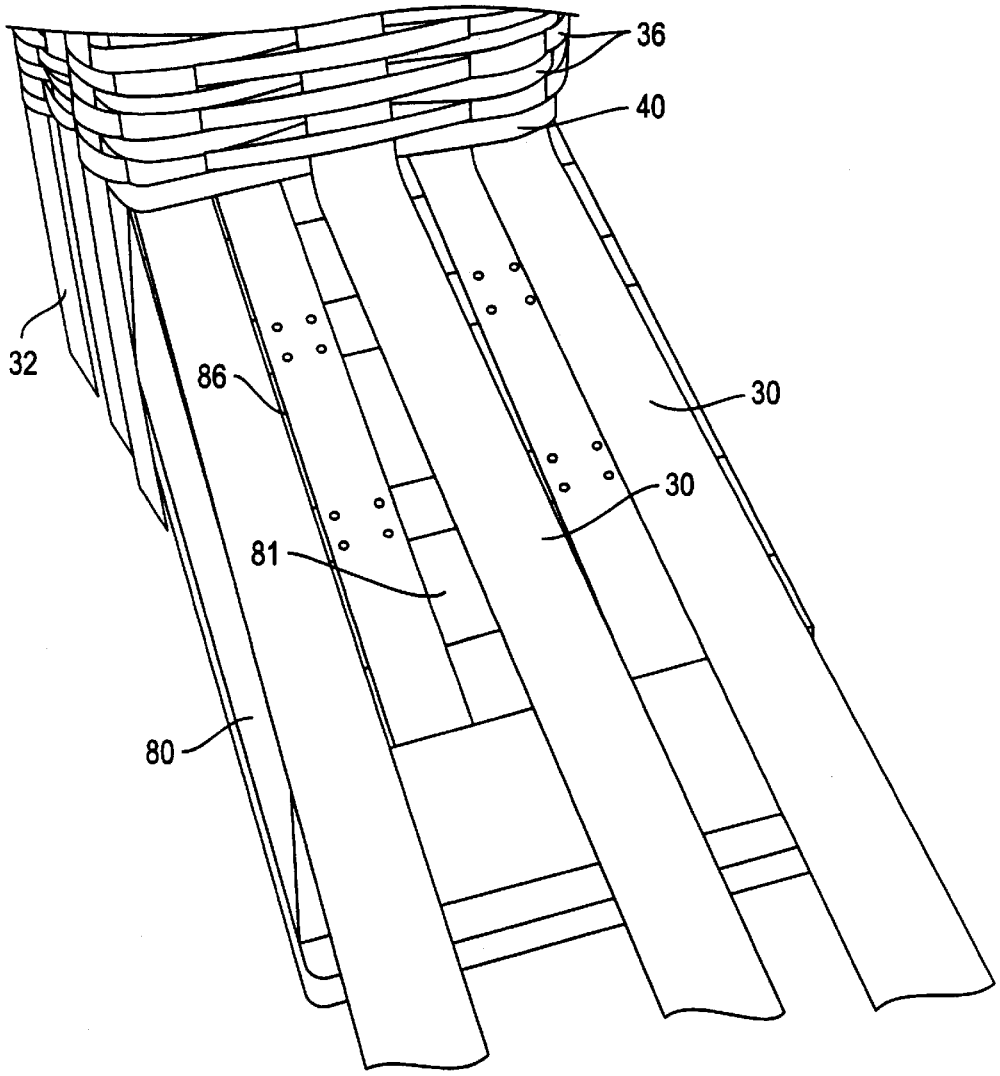
FIG. 14 is a view of the second form segment extending laterally from the first segment, with the upsplints bent over the top of the second segment and its integral reinforcement guides.

After the last weave strip 36 is added to the lower rear panel 16, the second segment 80 is connected to the first segment 70, as shown in FIG. 14, in preparation for forming the upper bottom panel 18. If desired, the placement of the combined form 68 on the weaving horse may be adjusted to accommodate the new center of gravity of the combined form 68, as described above.

The top 81 of the second segment 80 preferably includes an integral guide (shown in FIGS. 14 and 20E) for holding the inner reinforcements 60 of the upper bottom panel in position on the segment 80. The upper bottom panel 18 is formed by placing inner reinforcements 60 on the top of the second segment 80, preferably using the integral guide slots 86 to keep the reinforcements 60 from sliding out of position. The upsplints 30 from the lower rear panel 16 are bent at about a right angle so that they extend across the top of the second segment 80 (and over the inner reinforcements 60). Fill splints 38, which do not extend beyond the edges of upper bottom panel 18, may be arranged between the upsplints 30 to reduce the openness of the upper bottom panel 18.

Short splints 34, which will form the vertical structure of the shallow rear portion of the basket 10, are woven through the upsplints 30 and fill splints 38, as shown in FIG. 15. The short splint 34 closest to the front panel 12 and the lower rear panel 16, namely, short splint 42, is woven over the outer surface of the outermost upsplints 30 in the upper bottom panel 18. The remaining short splints 34 are woven through the upsplints 30 and fill splints 38 in any desired pattern, with an alternating, over-and-under pattern being preferred. Outer reinforcements 62 may be positioned over the upsplints 30 and secured to the splints and inner reinforcements of the upper bottom panel 18 as described above.

Figure 16:
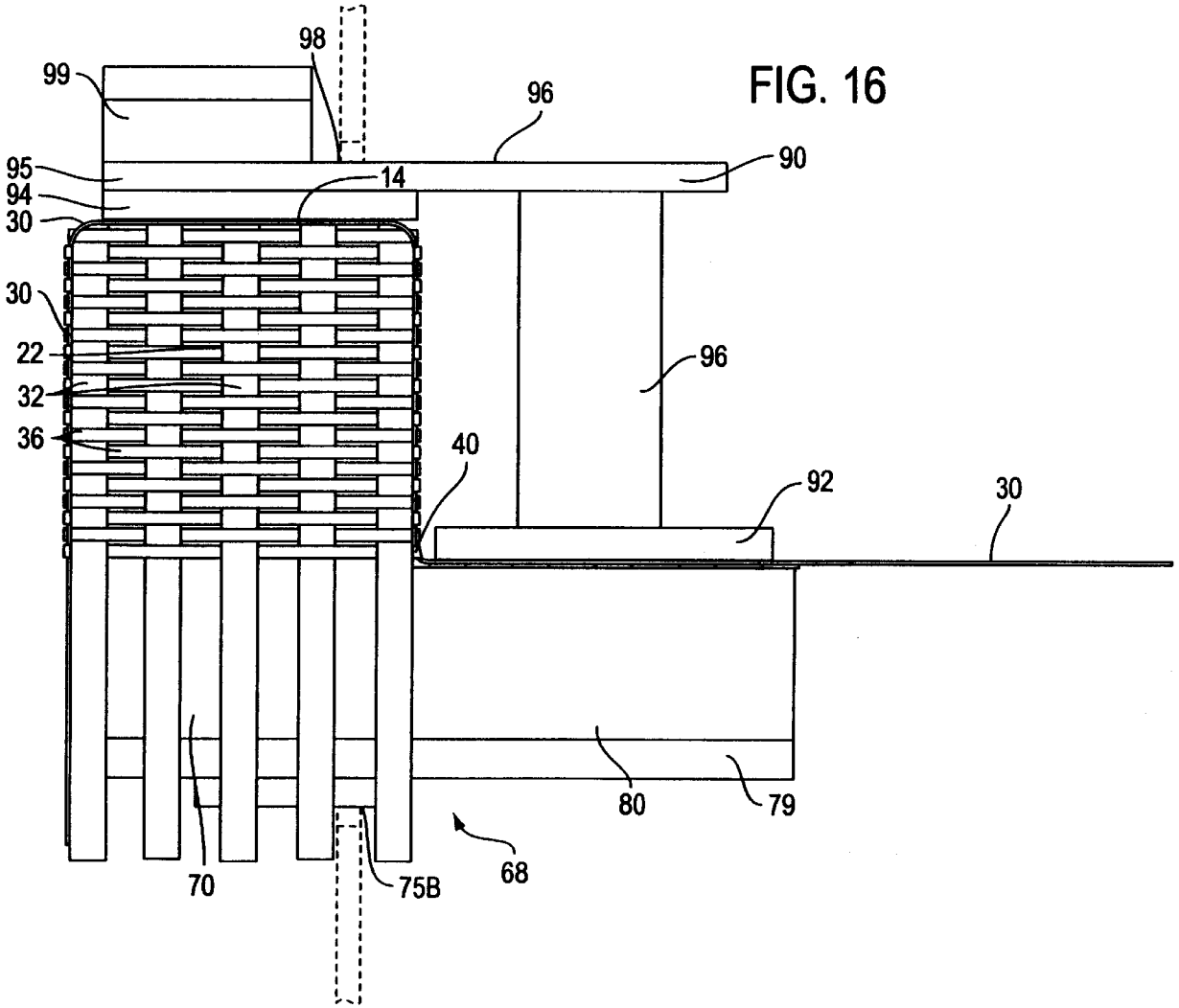
FIG. 16 is a view of the combined form with the lower and upper bottom panels secured thereto by a clamp.
Figure 22B:
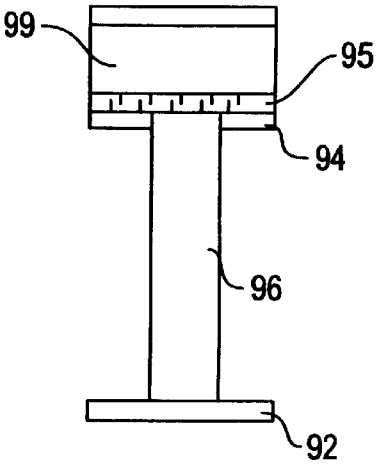
FIG. 22B is a rear view of the hold-down of FIG. 22A.
Figure 22C:
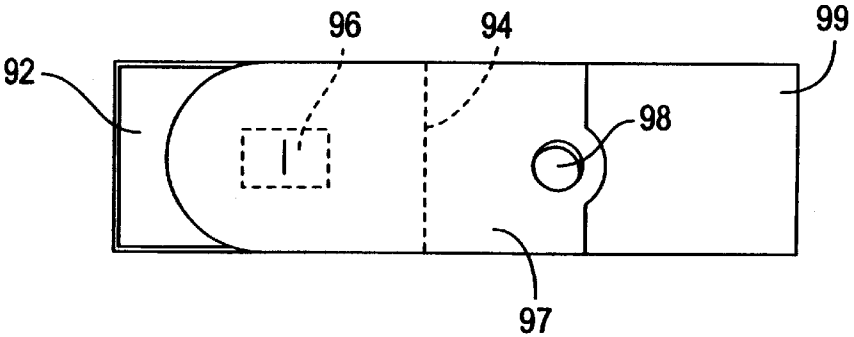
FIG. 22C is a top view of the hold-down of FIG. 22A.
Figure 22A:
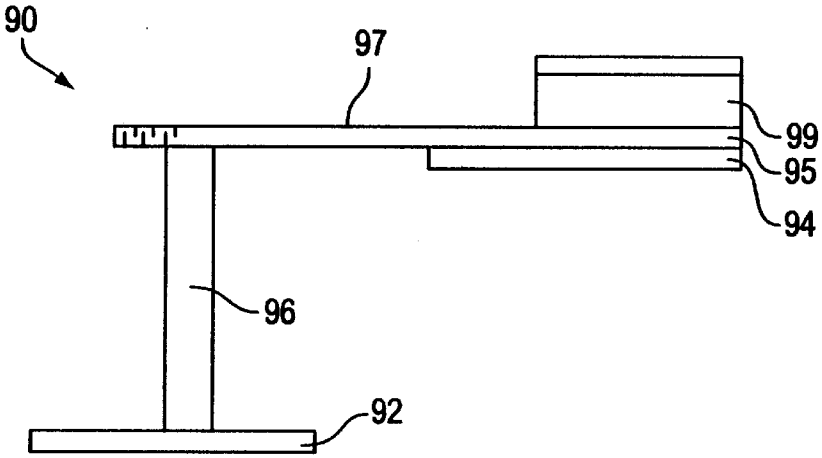
FIG. 22A is a side view of the hold-down device used to secure the basket bottom panels to the form of FIG. 21A.

After the upper bottom panel 18 has been formed, it is secured to the second segment 80 by a "hold-down" or clamp, shown in FIGS. 22A through 22C. Preferably, the conventional hold-down used to secure the lower bottom panel to the first segment 70 is removed and an L-shaped hold-down 90, best shown in FIGS. 16 and 22A, is used to secure both the upper 18 and lower 14 bottom panels to the combined form 68. The hold-down 90 defines parallel plates 92, 94 that press the upper 18 and lower 14 bottom panels, respectively, against the form 68. The plates 92, 94 are connected by an arm 95 extending from plate 94 toward plate 92, and a spacer 96 between arm 95 and plate 92. A recess 98 (shown in FIG. 22C) may be provided in the upper surface 97 of the arm 95 for securing the hold-down 90 to a weaving horse. A weight block 99 may be provided on the arm 95 to control the rotation of the combined form 68 and hold-down assembly on the weaving horse.

Figure 17:
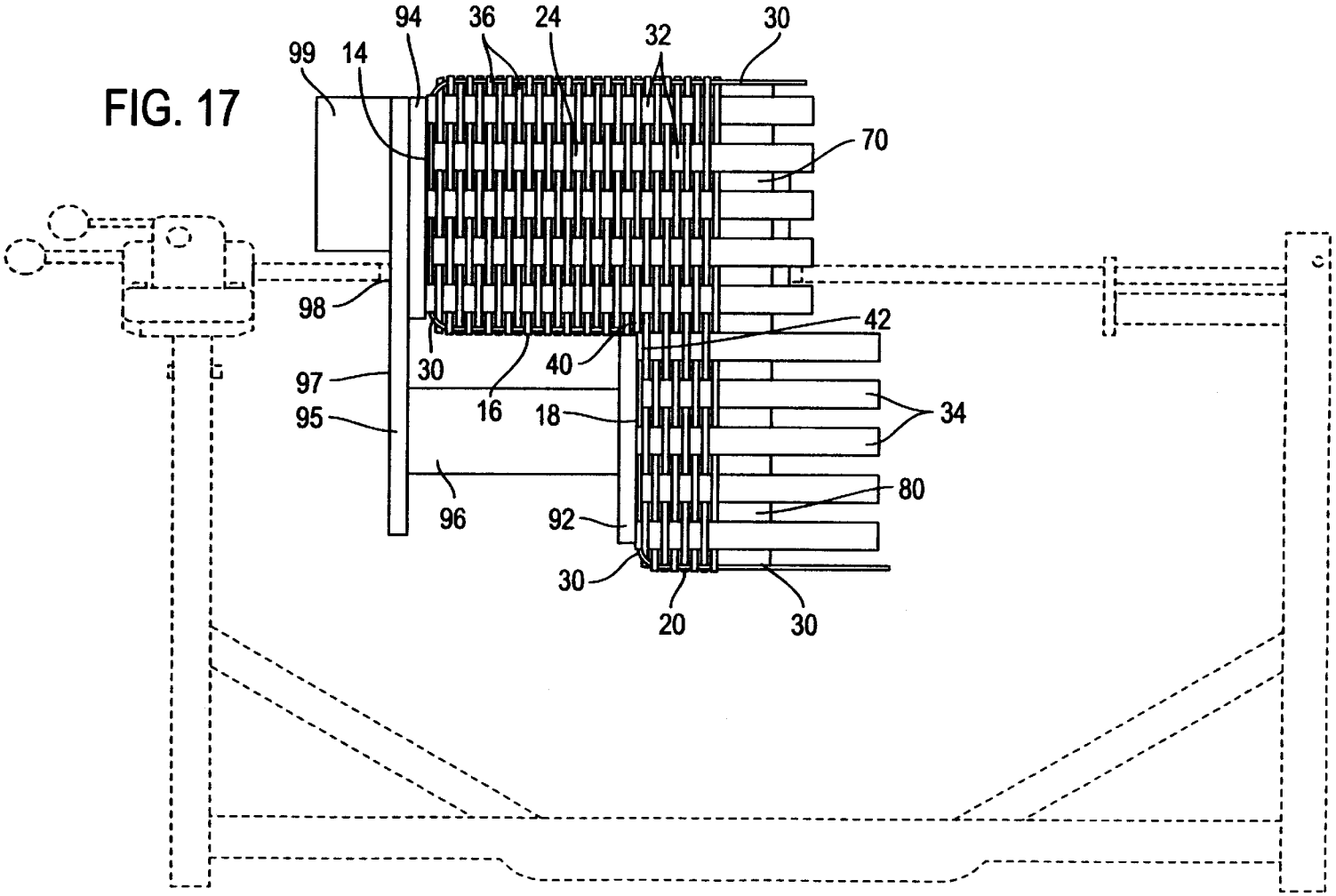
FIG. 17 is a view of the front and right side panels being constructed on the combined form of the present invention.

The upsplints 30 and short splints 34 extending beyond the borders of the upper bottom panel 18 are bent and shaped around the second segment 80, with the short splints 34 arranged substantially parallel to the cross splints 32 of the deep portion. An inner top band 52 may be secured by guides 78 provided along the bottom of the combined form 68 before construction of the remainder of the basket panels begins (shown in FIGS. 21A and 21B). FIG. 17 shows an inner top band secured in this position by guides 78.

Weave strips 36 are woven through the cross splints 32 and short splints 34 that collectively define the upper left 22 and right 24 panels and the upsplints 30 that define the front 12 and upper rear 20 panels. Any desired weave pattern may be used, with an alternating, over-and-under pattern being preferred. Successive rows of weave strips 36 are added until the panels reach a desired height. When weaving is complete, the ends of the splints 30, 32, 34 may be trimmed to a substantially uniform height that is slightly shorter than the desired height of the finished basket. The upper rim of the basket 10 is finished by securing the upper splint ends to a top band 50, which may include an inner top band 52 and an outer top band 54. When both inner 52 and outer 54 top bands are used, the splints 30, 32, 34 are sandwiched between the inner band 52 (which is held in position against the form by guides 78 along the bottom of the combined form 68 as shown in FIG. 17) and the outer band 54. Preferably, the splints are secured to the band(s) with fasteners.

Figure 5:
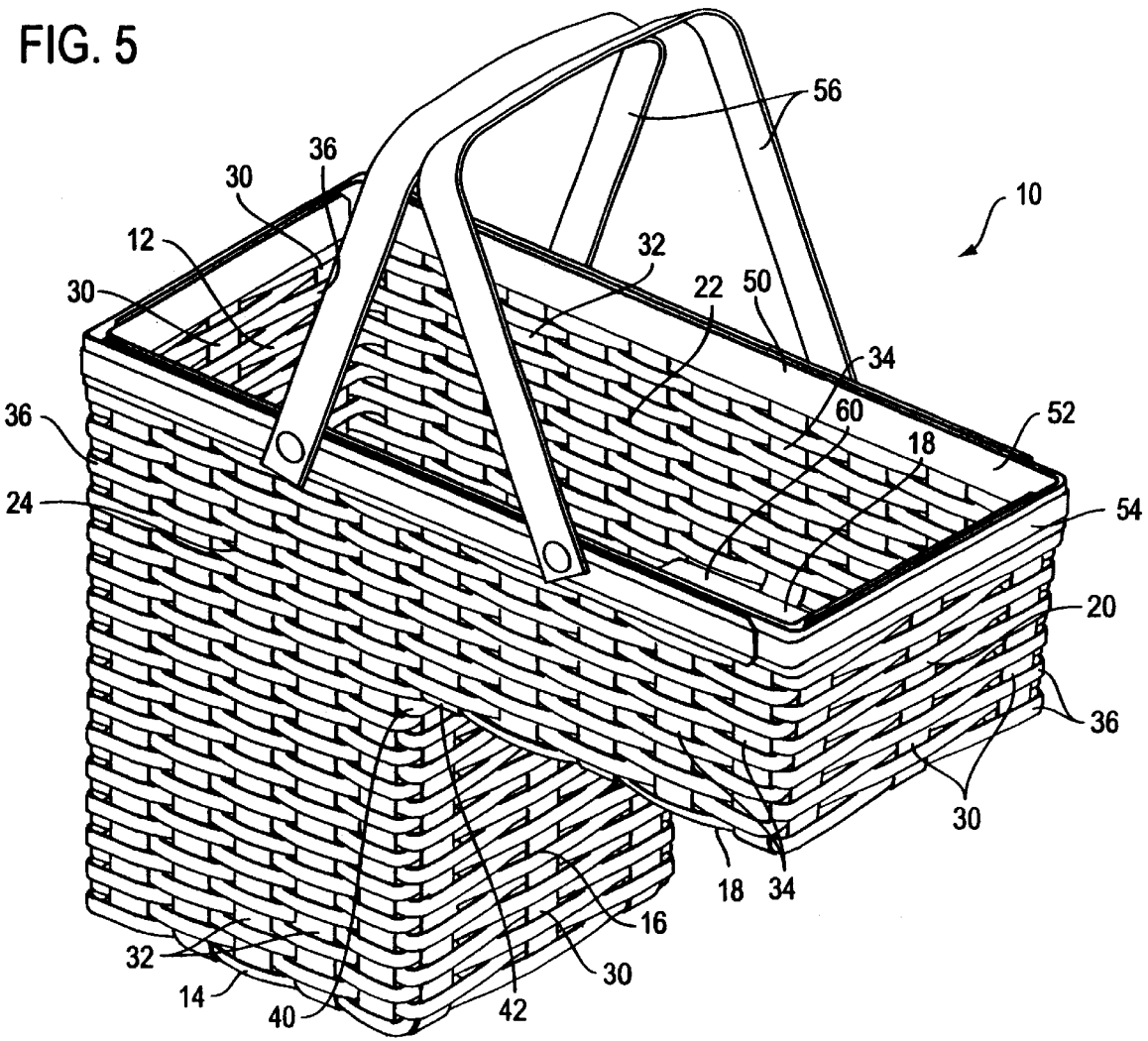
FIG. 5 is a right rear perspective view of another embodiment of the basket of the present invention.
Figure 6:
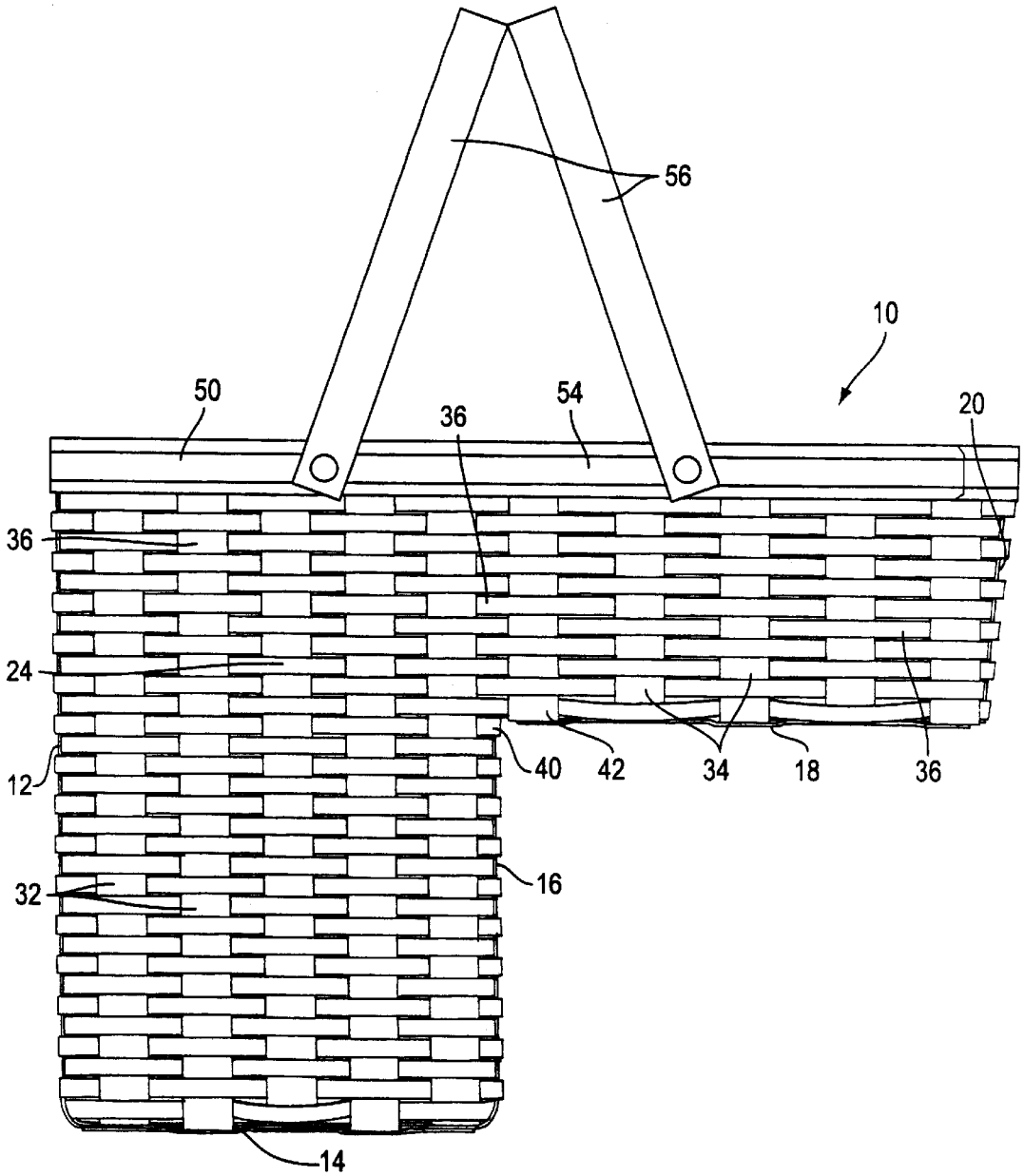
FIG. 6 is a right side view of the basket of FIG. 5, the left side being a mirror image thereof.

One or more handles may be secured to the basket if desired (best shown in FIGS. 5 and 6). Holes for securing a handle generally are drilled or otherwise formed in the basket before it is removed from the basket form 68 to reduce the risk of splitting of the top band 50. When the basket is completed, it may be removed from the form 68.

Although a two-part embodiment of the form of the present invention has been described in detail, other embodiments are within the scope of this invention, including three-part forms for use in making three-level baskets having either successively shallower bottom portions or a deep center section with shallower sections on either side. Variations may be made to the described embodiment by those skilled in the art without departing from the spirit of the invention or the scope of the appended claims.

We claim:

1. A form for a stepped-bottom basket having a deep front section and a shallow rear section, the upper front section being integral with the rear section, the form comprising:

a vertically partitioned frame including a first segment defining the shape of the interior of the deep front basket section and a second segment defining the shape of the interior of the shallow rear basket section, said second segment being independent of said first segment during weaving of the lower portion of the stepped-bottom basket and releasably fastened to said first segment during weaving of the upper portion of the basket.

2. The form according to claim 1, further including:

an L-shaped hold-down for pressing the upper and lower basket panels against the tops of the first and second mold segments.

3. A form for making a stepped-bottom basket, comprising:

a three-dimensional L-shaped frame vertically partitioned into a first segment including top, front, rear and side walls that define the shape of the interior of the deep portion of the stepped-bottom basket and a second segment including top, front, rear and side walls that define the shape of the interior of the shallow portion of the stepped-bottom basket, said first segment being independent of said second segment during weaving of the lower portion of the stepped-bottom basket and releasably fastened to said second segment during weaving of the upper portion of the stepped-bottom basket.

4. The form according to claim 3, further comprising a splint guide integrally formed into the top of the second segment.

5. The form according to claim 4 wherein said splint guide defines recessed slots in the top of the second segment capable of receiving inner reinforcement splints for the bottom of the shallow upper basket portion.

6. The form according to claim 3, wherein the first segment is used for forming the lower rear panel and the lower portions of the front, left, and right basket panels.

7. The form according to claim 6, wherein the second segment is fastened to the first segment to form a combined form, for forming the upper bottom panel, upper rear basket panel and the remainder of the front, left and right basket panels.

8. The form according to claim 3, wherein the upper back wall of the first segment abuts the front wall of the second segment with the bottoms of the segments substantially aligned.

9. The form according to claim 8, wherein the upper back wall of the first segment is shaped for mating with the front wall of the second segment.

10. The form according to claim 9, wherein the wall of one of said segments includes a projecting member that engages a corresponding recess in an abutting wall of the other segment.

11. The form according to claim 10, wherein the projecting member tends to urge the segments into closer engagement.

12. The form according to claim 2, wherein the first segment further includes a bottom, said bottom defining first and second recesses for supporting the form on a weaving horse.

13. The form according to claim 11, wherein said first recess is substantially centered on the first segment bottom.

14. The form according to claim 13, wherein said first recess is located between the second recess and the side of the first segment adjacent to the second segment.

15. The form according to claim 14, wherein said first recess is used to support the first segment during weaving.

16. The form according to claim 15, wherein said second recess is used to support the combined first and second segments during weaving.

17. The form according to claim 16, further including a protective band along the portions of the segments that define the bottom perimeter of the combined form.

18. A form for making a stepped-bottom basket including lower bottom, lower rear, upper bottom, upper rear, front, left and right panels, said form comprising:

a first form segment used for forming the lower rear basket panel and the lower portions of the front, left, and right basket panels; and a second form segment independent of said first segment during forming of the lower rear basket panel and the lower portions of the front, left, and right basket panels and releasably fastened to said first segment to define a combined form during forming of the upper bottom panel, rear basket panel and the remainder of the front, left and right basket panels.

19. The form according to claim 18, wherein one of said segments includes a fastener that engages a corresponding fastener on the other segment, said fastener urging the segments closer together.

* * * * *